United States Patent [19]

Stuckey

[11] 4,056,049

[45] Nov. 1, 1977

[54] SPACE HUMIDIFIER

[76] Inventor: Milton C. Stuckey, Rte. No. 6, Box 241A, Macon, Ga. 31201

[21] Appl. No.: 701,904

[22] Filed: July 1, 1976

[51] Int. Cl.[2] ..... F24F 13/06

[52] U.S. Cl. ..... 98/105; 261/119 R

[58] Field of Search ..... 98/12, 17, 30, 100, 98/105, 109; 261/119 R; 55/244, 260; 126/113, 134, 313

[56] References Cited

U.S. PATENT DOCUMENTS

| | | | |
|---|---|---|---|
| 99,864 | 2/1870 | Ebert | 98/109 |
| 526,653 | 9/1894 | Iliowizi | 98/105 |
| 966,842 | 8/1910 | Lewis | 98/105 |
| 1,886,028 | 11/1932 | Klosterman | 98/105 |
| 2,043,647 | 6/1936 | Berven | 261/119 R |

*Primary Examiner*—Ronald C. Capassela
*Attorney, Agent, or Firm*—Robert B. Kennedy

[57] ABSTRACT

A space humidifier for humidifying air being forced into a room through a vent located adjacent the room floor. The space humidifier comprises a casing sized to be seated over the floor vent, an air shaft within the casing, a reservoir mounted within the casing aside the air shaft, a baffle for deflecting air rising out from the air shaft downwardly into the reservoir, and a lid having an opening mounted atop the casing above the reservoir.

6 Claims, 4 Drawing Figures

SPACE HUMIDIFIER

BACKGROUND OF THE INVENTION

This invention relates to space humidifiers for humidifying heated air forced into rooms through floor vents.

Space air cleaners and humidifiers, as exemplified by those disclosed in U.S. Pat. Nos. 526,653, 561,134, 1,845,728 and 1,886,028, have heretofore been developed for cleaning and humidifying heated air that is being forced into a space or room through a vent or register mounted adjacent the room floor. Typically, these devices have included a casing sized to be seated over the room vent, and a reservoir such as a bucket or pan removably positioned within the casing, With this basic type of space humidifier air rising from the room vent is directed over the surface of water disposed within the reservoir thereby adding humidity to the air passing through the casing prior to its departure therefrom. Some humidifiers have also been provided with ventilators or fans for increasing the flow of air over the surface of the water within the reservoir, and with means for automatically controlling the level of water therewithin.

Though space humidifiers of the type described have been successfully used in humidifying heated air being forced into individual spaces or rooms as from a centralized furnace, they have met with but minimal success. This lack of commercial success has been attributable to a dilemma presented with the prior art humidifiers. Specifically, the space humidifiers of relatively simple structure and cost have been without means for automatically controlling their supply of water. The simple type therefore periodically requires a manual replenishment of water which replenishment operation requires temporary relocation of at least a portion of the humidifier casing or removal of the portable reservoir seated therewithin. Since the reservoir itself is normally not visible from the casing exterior, the quantity of water therewithin is not readily gaugeable. On the other hand, those space humidifiers which include means for automatically controlling their quantity of water are more complex, costly and in need for periodic maintenance and repair.

Accordingly, it is a general object of the present invention to provide an improved space humidifier.

More specifically, it is an object of the present invention to provide a space humidifier of improved simplicity and operative reliability.

Another object of the invention is to provide a space humidifier to which water may be periodically added without alteration or removal of humidifier components.

Another object of the invention is to provide a space humidifier to which water may be added without the removal of the humidifier lid or cover or other casing component.

Another object of the invention is to provide a space humidifier of the type described which does not require a coupling to ancillary water or electrical supplies.

Another object of the invention is to provide a space humidifier of the type described in which the quantity of water housed therewithin at any one time may be readily visualized without removal of any portion thereof.

Yet another object of the invention is to provide a space humidifier that provides improved flow of heated air over the surface of water disposed therewithin.

SUMMARY OF THE INVENTION

In one form of the invention a space humidifier is provided for humidifying air being forced into a room through a vent located adjacent the room floor. The space humidifier comprises a casing sized to be seated over the floor vent, an air shaft within the casing, a reservoir mounted within the casing aside the air shaft, baffle means for deflecting air rising from the air shaft downwardly into the receptacle, and a lid having an opening mounted atop the casing above the reservoir.

DESCRIPTION OF THE PREFERRED EMBODIMENTS

Figure 1:
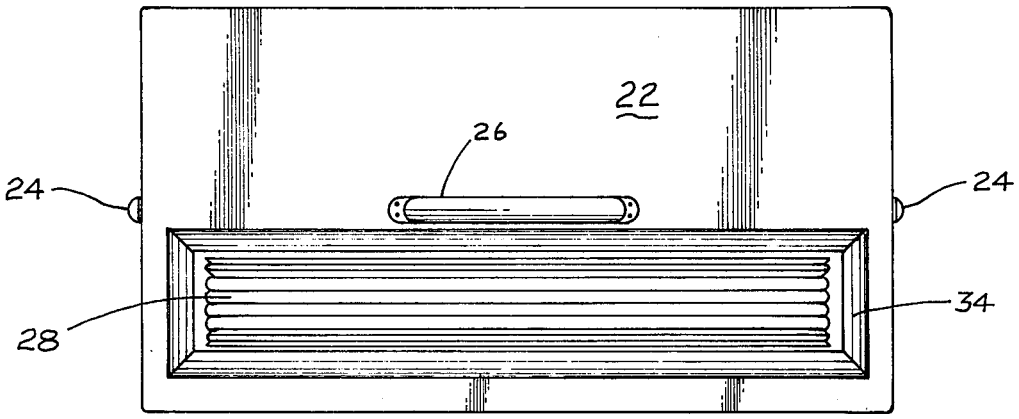
FIG. 1 is a plan view of a space humidifier embodying principles of the invention in one preferred form.
Figure 2:
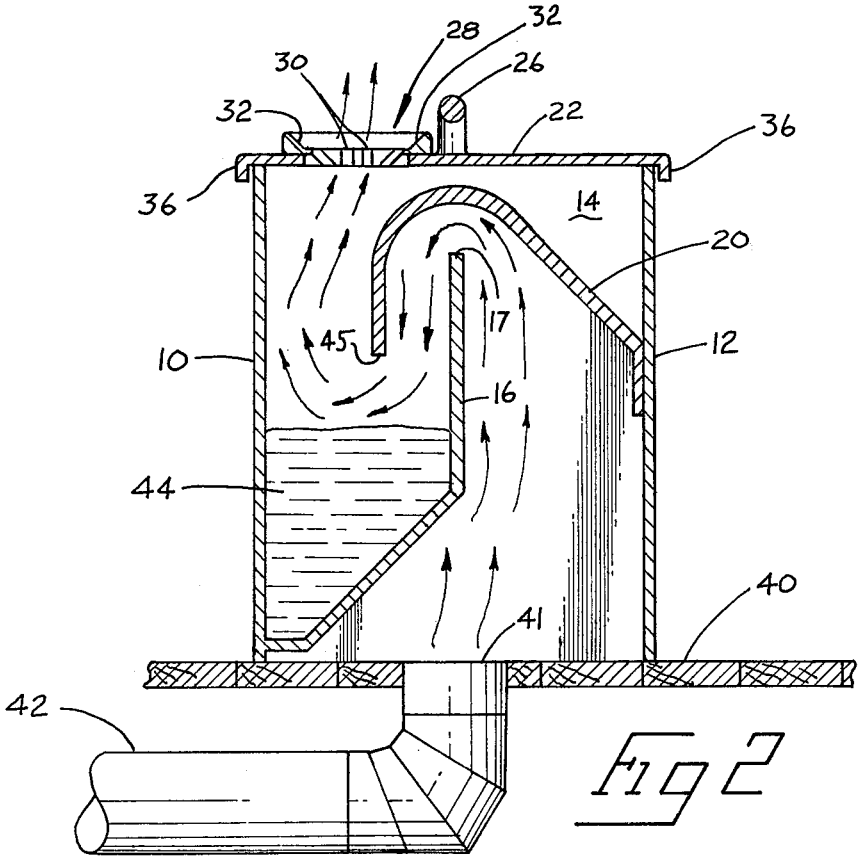
FIG. 2 is a side elevational view, in cross-section, of the space humidifier shown in FIG. 1 in operation.

Referring now in more detail to the drawing, there is shown in FIGS. 1 and 2 a space humidifier comprising a generally rectangular open top and bottom sheet metal casing having a front panel 10, a rear panel 12 and two opposed side panels 14. If desired, the casing may be made of plastic instead of metal. Within the casing is integrally mounted to the casing front and side panels a partition 16. This partition is also of sheet metal and extends generally rearwardly from the casing front panel 10 and then upwardly first along an inclined plane and then along a vertical plane terminating at a top partition edge 17. Within the casing is also mounted a sheet metal baffle 20 to the casing rear panel 12 and to the two casing side panels 14. The baffle extends at an incline upwardly from the rear panel and then arcs overly and in spaced relation with the top edge 17 of partition 16 and then downwardly parallel with the other side of the partition from the rear panel.

The humidifier also has a rectangular sheet metal lid 22 with depending flanges 36 adapted to be releasably held atop the casing by a pair of conventional latches 24 mounted to the lid flanges. The lid is provided with a handle 26 and with a vent 28. A grating is mounted within the vent which grating comprises a pair of vertically oriented vanes 30 mounted between a pair of inclined vanes 32 sloping downwardly from the sides of the vent toward the vertical vanes. A rectangular funnel 34 is rigidly mounted atop the lid about the inclined vanes 32. So constructed, the humidifier is provided with an air shaft extending generally upwardly from the open bottom of the casing between partition 16 and casing rear panel 12, a trough-shaped liquid reservoir located aside the air shaft between the casing front panel 10 and partition 16, and a grating through which humidified air may exit and water may be funneled.

For operation the space humidifier is seated upon a room foor 40 about an outlet 41 of an air duct 42. A supply of water 44 is disposed within the humidifier reservoir with the water level located beneath the lower edge 45 of baffle 20. This water may be poured into the reservoir either through the vent and grating in the lid, or with the lid temporarily removed from atop the casing. If poured through the vent and grating the upper, arcuate surface of the baffle deflects water away from the air shaft and into the reservoir. As heated air is forced from a central furnace through duct 42 it enters the space humidifier and rises through the air shaft. At the top of the air shaft it is deflected by baffle 20 over the top edge 17 of the partition and then downwardly into the humidifier reservoir. From here the heated air passes over the surface of the body of water 44 thereby adding humidity to the heated air. From here the air is forced upwardly toward lid 22 and out through the vent 28 and grating.

Figure 3:
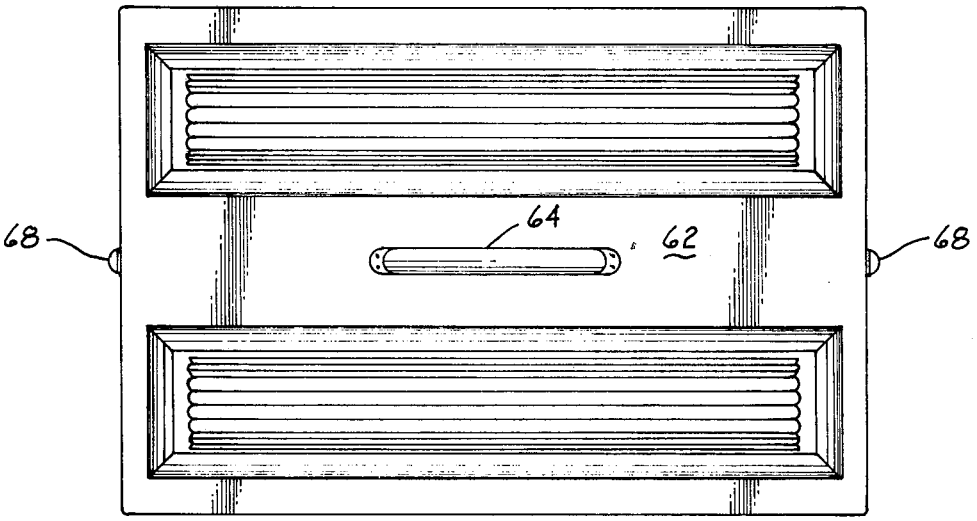
FIG. 3 is a plan view of a space humidifier embodying principles of the invention in an alternative form.
Figure 4:
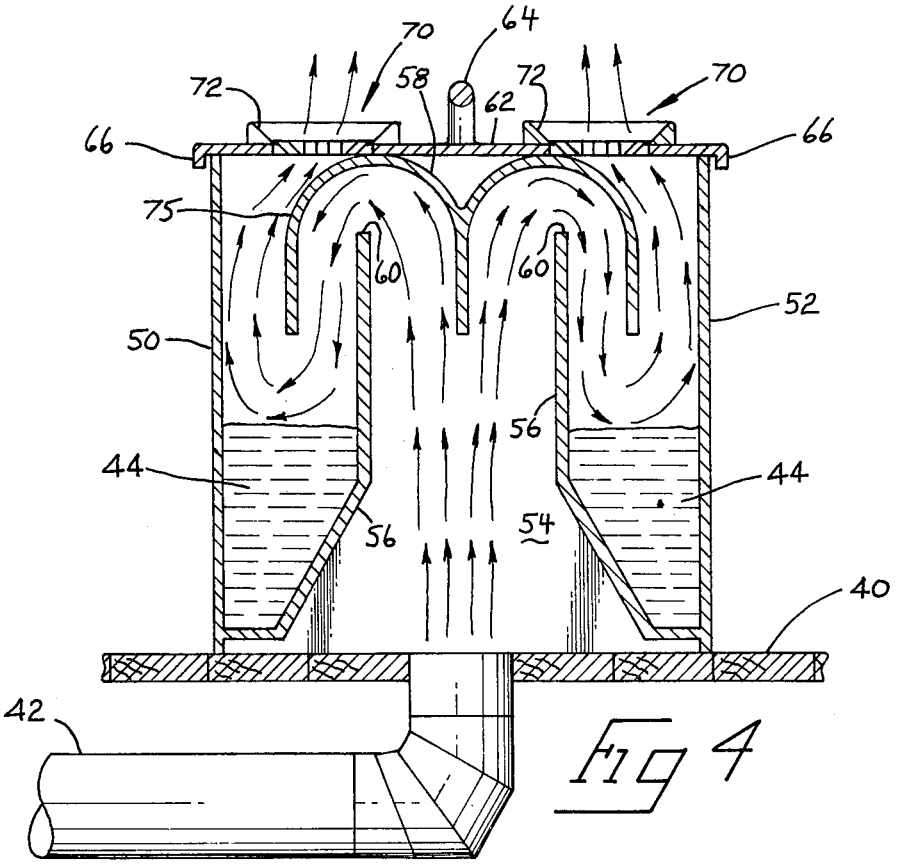
FIG. 4 is a side elevational view, in cross-section, of the space humidifier shown in FIG. 3 in operation.

With reference next to FIGS. 3 and 4 a space humidifier is shown in an alternative form which again comprises a generally rectangular, open bottom, sheet metal casing having a front panel 50, a rear panel 52, and two mutually opposed side panels 54 conjoined at the side edges with the front and rear panels. In this embodiment the space humidifier has two interior parallel partitions 56 with one of the partitions mounted to the two side walls and to the front panel 50 while the other partition 56 is mounted to the two side walls and the rear panel 52. A baffle 58 is mounted within the casing to the two side panels 56. The baffle comprises two inverted U-shaped conjoined sections with each section overlaying the top edge 60 of one of the partitions 56. The legs of each inverted U-shaped baffle section project downwardly to either side of an upper portion of the partitions. So, constructed, th interior of the casing is compartmentalized into two trough-shaped reservoirs between the partitions and the front and real panels, and a central air shaft disposed between the two partitions. The space humidifier also has a lid 62 to the top of which is mounted a handle 64. The side edges of the lid are provided with dependent flanges 66 adapted to be placed above th upper edge of the casing. Again, the lid is provided with a pair of releasable latches 68 for removably securing the lid atop the casing. In this embodiment the lid is provided with two independent vents 70 disposed above the two reservoirs in each of which vent is mounted a grating constructed as previously described. Similarly, a rectangular funnel 72 is rigidly secured atop the lid about the vents and gratings for permitting air to pass through the top of the lid while simultaneously enabling water to be poured down therethrough without the necessity of removing the lid. Here it will be noted that the uppermost portion of the baffle is in abutment with the lid. So assembled, water poured through either lid grating is directed away from the air shaft and down into either of the two reservoirs disposed aside the air shaft.

In operation, the double reservoir embodiment described in FIGS. 3 and 4 functions quite similarly to the previously described embodiment. The casing is placed about the outlet of an air duct 42 mounted below floor 40. Preferably, the casing is provided with the four walls shown thereby completely enclosing the space about the outlet of the air duct. However, it should be realized that provision of a casing having four encircling walls is not mandatory inasmuch as one or more walls of the room itself may function as one wall of the humidifier. Indeed, a three wall casing is preferable where the air duct vent is located adjacent the floor baseboard in a room wall rather than actually in the floor.

Once the casing is in place water is added to the two reservoirs either by removal of the lid or by being poured through the grating formed within the two lid vents. In either case the outer, convex portion of the baffle indicated at 75 serves to deflect water being poured into the casing away from the central air duct so that spillage does not occur thereinto. Once the reservoir is filled with water to a level below the bottom of the dependent legs of the baffle extending downwardly into the reservoir, the lid is latched. Heated air then forced out of the air duct rises within the air shaft and then is bifurcatedly deflected by the baffle over the tops of the partitions 56 and then down into the two reservoirs. As the heated air passes over the surface of the two bodies of water 44 humidity is added to the air. From here the air passes upwardly over the outboard sides of the baffle and exits through the two lid gratings.

It should be understood that the just described embodiments merely illustrate principles of the invention in two preferred forms. Many modifications, additions and deletions may, of course, be made thereto without departure from the spirit and scope of the invention as set forth in the following claims.

I claim:

1. A space humidifier for humidifying air being forced into a room through a floor vent and with the space humidifier comprising a casing having a front, a back and two sides extending upwardly about an open casing bottom sized to be seated upon the room floor over and about the floor vent; a lid having a vent mounted atop said casing; a partition extending upwardly within said casing between said two casing sides; a reservoir within said casing to one side of said partition below said lid vent; an air shaft within said casing to the oter side of said partition opposite said one side; and baffle means for deflecting air rising from said air shaft downwardly into said reservoir and then upwardly out of said casing through said lid vent including a baffle mounted within said casing extending between the top of said partition and said lid.

2. A space humidifier in accordance with claim 1 wherein said baffle extends arcuately beneath a portion of said lid vent whereby one baffle surface may deflect air downwardly into said reservoir away from said lid vent and the opposite surface of said baffle may deflect water poured through said lid vent away from said air shaft and into said reservoir.

3. A space humidifier in accordance with claim 1 wherein said lid is removable mounted atop said casing.

4. A space humidifier in accordance with claim 1 further comprising a grating mounted in said lid vent with said grating including downwardly convergent deflector means for deflecting liquid poured therethrough into said reservoir and away from said air shaft.

5. A space humidifier in accordance with claim 1 wherein said reservoir is mounted to one side of said air shaft and wherein said humidifier further comprises a second reservoir mounted within said casing to the side of said air shaft opposite said one side.

6. A space humidifier in accordance with claim 5 wherein said lid has a second vent above said second reservoir, and wherein said lid has a first grating mounted in said lid vent, a second grating mounted in said second lid vent, and wherein said first and second gratings have vanes for directing water downwardly away from said air shaft.

* * * * *